United States Patent [19]

Ushiota et al.

[11] Patent Number: 5,030,067

[45] Date of Patent: Jul. 9, 1991

[54] AIR COMPRESSOR ASSEMBLY

[75] Inventors: Harutsugu Ushiota, Sagamihara; Akihiko Hama, Yokohama; Hiroshi Oshigami, Atsugi; Toshio Inoue, Isehara; Yoshio Konno; Hachiro Nakagawa, both of Yokohama, all of Japan

[73] Assignee: Tokico Limited, Kawasaki, Japan

[21] Appl. No.: 381,965

[22] Filed: Jul. 19, 1989

[30] Foreign Application Priority Data

| | | | |
|---|---|---|---|
| Jul. 20, 1988 | [JP] | Japan | 63-96163[U] |
| Aug. 18, 1988 | [JP] | Japan | 63-108597[U] |
| Mar. 20, 1989 | [JP] | Japan | 1-67938 |

[51] Int. Cl.[5] ..... F04B 21/00

[52] U.S. Cl. ..... 417/313; 417/360; 417/234

[58] Field of Search ..... 417/360, 313, 234, 571

[56] References Cited

U.S. PATENT DOCUMENTS

| | | | |
|---|---|---|---|
| 1,771,889 | 7/1930 | Hobart | 417/234 |
| 4,696,626 | 9/1987 | Hata et al. | 417/363 |

FOREIGN PATENT DOCUMENTS

| | | | |
|---|---|---|---|
| 884098 | 7/1942 | France | 417/363 |
| 1263641 | 7/1960 | France | 417/234 |

OTHER PUBLICATIONS

Cole-Parmer catalogue, 1987-1988 edition, p. 701.

*Primary Examiner*—Leonard E. Smith
*Assistant Examiner*—David W. Scheuermann
*Attorney, Agent, or Firm*—Oblon, Spivak, McClelland, Maier & Neustadt

[57] ABSTRACT

The present invention relates to an air compressor assembly. The compressor assembly includes an air tank, a compressor body, and a joining part for joining the air tank and the compressor body. The air tank has an axis therealong. The compressor body adjacent to the tank has an axis therealong for supplying compressed air to the air tank, the axis of the compressor body being disposed parallel to the axis of the tank. The compressor body includes a cylinder head, the cylinder head having an axis therealong, the axis of the cylinder head being disposed perpendicular to the axis of the compressor body and inclined to the tank.

6 Claims, 6 Drawing Sheets

AIR COMPRESSOR ASSEMBLY

BACKGROUND OF THE INVENTION

The present invention relates to a portable compact air compressor assembly.

FIGS. 1 and 2 depict a conventional portable air compressor assembly having an air tank 20, and a compressor body which are aligned vertically, the compressor body including motor 22, cylinder head 24, etc. The motor 22 is mounted on the air tank 20 through a pair of motor bases 26. The air tank 20 has a pair of legs 28 at the bottom thereof, and a pressure switch 30, safety valve 32 for adjusting the pressure, and pressure gage 34 at the top thereof.

The compressor assembly is not stable for standing during operation and is so tall as to be difficult and inconvenient for transporting.

FIGS. 3 and 4 depict another conventional portable air compressor assembly having an air tank 20, and a compressor body which are aligned horizontally, the compressor body including motor 22, cylinder head 24, and so on. The air tank 20 and the compressor body are mounted on a stage 36. The air tank 20 has a pressure switch 30, safety valve 32 for adjusting the pressure, and pressure gage 34 at the top thereof.

The compressor assembly is also bulky and heavy so as to be difficult and inconvenient for transporting.

SUMMARY OF THE INVENTION

It is therefore an object of the present invention to provide a light and compact air compressor assembly which is convenient to transport and stable when standing.

It is another object of the present invention to provide a compact air compressor assembly which is easy to construct.

It is a further object of the present invention to provide a compact air compressor assembly which has legs effectively suppressing the vibration of the air compressor.

According to a preferred embodiment of the present invention, the compressor assembly includes an air tank, a compressor body, and a joining part for joining the air tank and the compressor body. The air tank has an axis therealong. The compressor body adjacent to the tank has an axis therealong for supplying compressed air to the air tank, the axis of the compressor body being disposed parallel to the axis of the tank, The compressor body includes a cylinder head, the cylinder head having an axis therealong, the axis of the cylinder head being disposed perpendicular to the axis of the compressor body and inclined to the tank. Since the cylinder head is inclined so as to be close to the tank, the air compressor assembly is of a more compact scale and is more stable for standing.

Preferably, the joining part has a fixed portion and an attached portion. The fixed portion is fixed to the air tank. The attached portion is detachably attached to the compressor body, or vice versa.

It is preferred that the compressor body and the air tank having a plurality of legs. The legs are attached to the compressor body and the air tank in an imaginary plane which is opposite to the cylinder head via the axis of the compressor body. Each of the legs has a spring modulus according to the distribution of the weight of the compressor assembly such that a natural frequency f of the compressor assembly is given by the following formula:

$$f<N/1.4$$

wherein N is a frequency of the compressor assembly while the compressor body is driven. Therefore, vibration of the compressor assembly, which may be caused by the rotation of the motor or the like within the compressor body, can be effectively suppressed.

It is further preferred that the compressor body and the air tank respectively include engaging parts for engaging respectively with the legs. The engaging parts have various configurations respectively. The legs also have various configurations respectively to be engaged with the engaging parts respectively so that there is no confusion when engaging each set of the engaging parts and the legs.

DETAILED DESCRIPTION OF THE PREFERRED EMBODIMENTS

With reference to the accompanying drawings, various embodiments of the present invention will be described hereinafter.

FIRST EMBODIMENT

Figure 1:
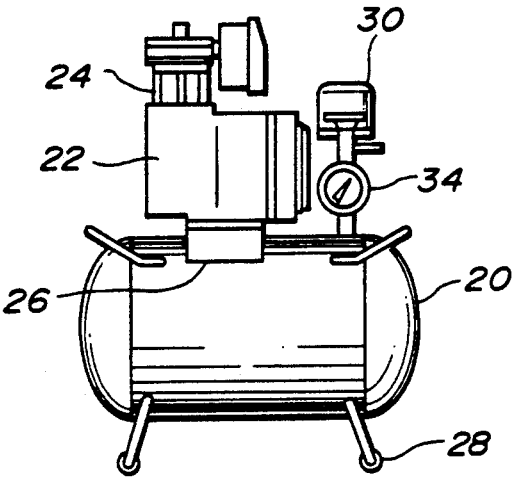
FIG. 1 (PRIOR ART)
FIGS. 1 and 2 are respectively a side view and front view showing a conventional portable air compressor assembly.
Figure 2:
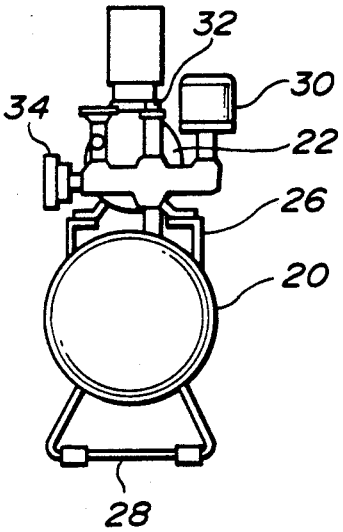
FIG. 2 (PRIOR ART)
Figure 3:
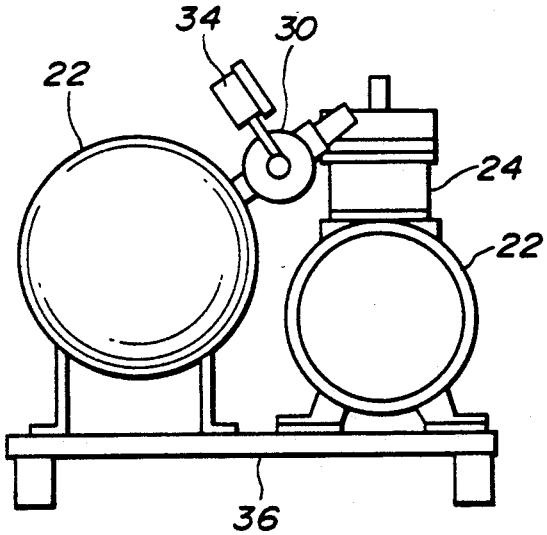
FIG. 3 (PRIOR ART)
FIGS. 3 and 4 are respectively a front view and side view showing another conventional portable air compressor assembly.
Figure 4:
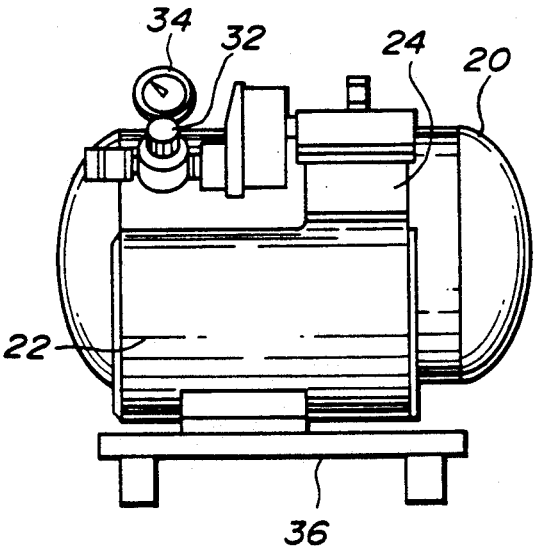
FIG. 4 (PRIOR ART)
Figure 5:
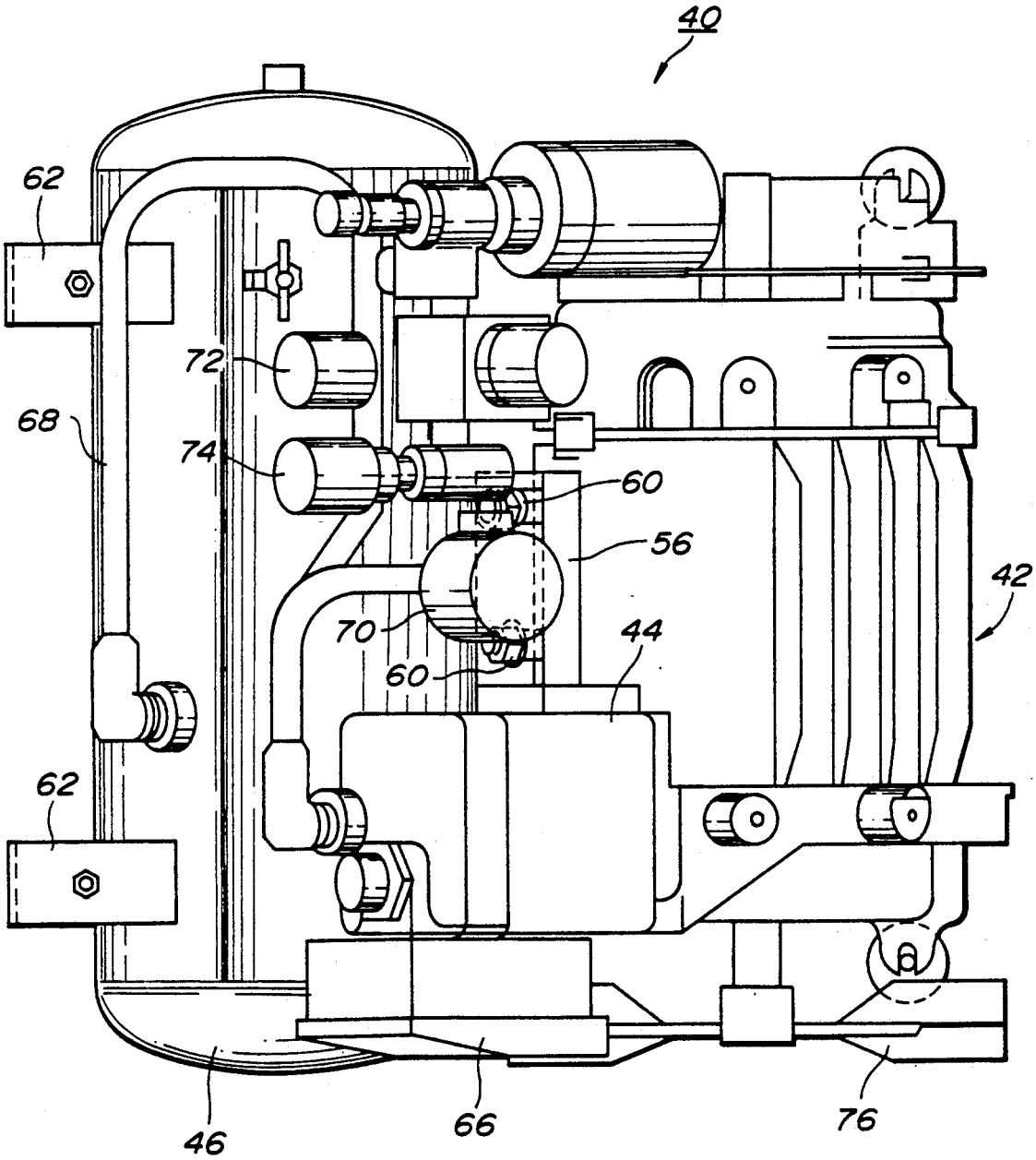
FIGS. 5 and 6 are respectively a plan view and side view showing a portable air compressor assembly according to a first embodiment of the present invention.
Figure 6:
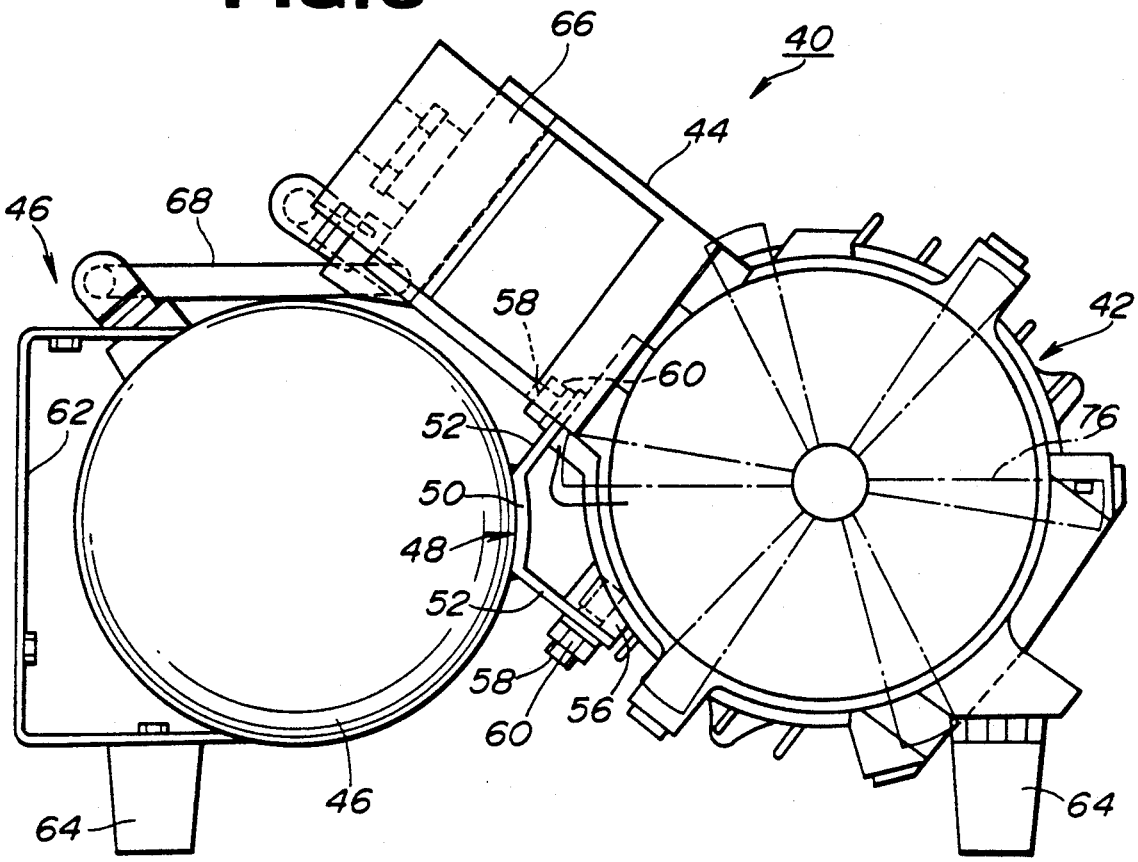

FIGS. 5 and 6 depict a compact portable air compressor assembly 40 according to a first embodiment of the present invention. The air compressor assembly 40 has a compressor body 42 and an air tank 46 which have axes therealong parallel to each other. The compressor body 42 includes a cylinder head 44. The cylinder head 44 has an axis therealong which is perpendicular to the axis of the compressor body 42. The air tank 46 of a cylindrical air-tight vessel is disposed in such a manner that the axis thereof is horizontal.

The body 42 also of a cylindrical shape, which is disposed in the same elevation to the compressor body 42 in such a manner that the axis thereof is horizontal, contains a motor (not shown) and a crank mechanism (not shown) for reciprocation with a piston (not shown) within the cylinder head 44.

The compressor body 42 and the air tank 46 are joined through a joining part 48 in such a manner that the cylinder head 44 is inclined towards the tank 46. Therefore, the cylinder head 44 is located on a middle portion between the tank 46 and the compressor body 42 in the plan view.

A pair of generally U-shaped handles 62 are attached to the tank 46 in such a manner that the handles 62 extend outward of the compressor assembly. Four legs 64 made of rubber are affixed to the bottom of the compressor body 42 and the handles 62 in such a manner that a pair of the legs 64 are disposed on an imaginary line parallel to the axis of the compressor body 42; and another pair of the legs 64 are disposed along the elongated direction of handles 62. Therefore, the legs 64 are disposed in an imaginary plane which is opposite to the cylinder head 44 via the axis of the compressor body 42.

Figure 7:
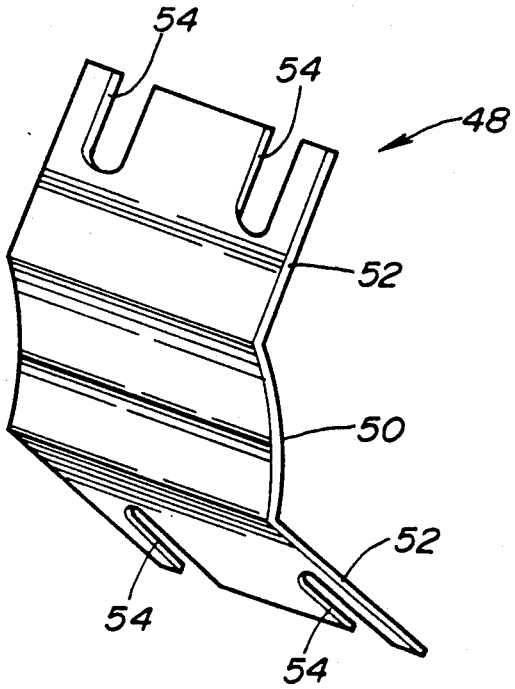
FIG. 7 is a perspective view showing a joining part used in the air compressor assembly of the first embodiment.

As best shown in FIG. 6 with FIG. 7, the joining part 48 is constituted by an arc-shaped plate or fixed portion 50 to be fitted and welded to the outer peripheral face of the tank 46, and a pair of plane plates or detachably attached portions 52 and 54 extending generally radially outward from both ends of the arc-shaped plate 50. Each of the plane plates 52 and 54 has a pair of U-shaped slits. The joining part 48 is disposed at almost the center of the plan view of the air compressor 40 assembly as shown in FIG. 5.

The compressor body 42 has a pair of projections 56 at the outer peripheral face thereof to coincide with the plane plates 52 of the joining part 50 affixed to the tank 46. The projection 56 has a rectangular top surface. At each of the top surfaces of the projections 56, a pair of bolts 58 is embedded in such a manner that the anchor bolts stand perpendicular on the top surface.

In order to join unitedly the compressor body 42 and the tank 46, the slits 54 of the joining part 48 welded to the tank 46 and the anchor bolts 58 may be held in engagement with each other. Then, nuts 60 are fitted to the anchor bolts 58 and tightened by a wrench. Consequently, the air tank 46 is joined through a joining part 48 to the compressor body 42.

Next, a muffler 66 for muffling noise of receiving air, a pipe 68 for joining the cylinder head 44 and the tank 46, a pressure gage 70, pressure valve 72, safety valve 74, fin 76 and so on are installed to the prescribed position in a condition that the legs 64 contact the floor or ground.

With the above construction, the motor within the compressor body 42 rotates and compresses air in the cylinder head 44. The compressed air flows into and is stored in the air tank 46 for a time, and is later supplied to a machine utilizing the compressed air.

Since the cylinder head 44 is inclined to be as close as possible to the outer peripheral face of the tank 46, the portable air compressor assembly 40 has a more compact scale than conventional air compressors. Moreover, the tank 46 and the compressor body 42 can be joined by only the joining part 48 and the bolt-nut mechanisms, so that the entire compressor assembly is of a light weight. Furthermore, since the compressor body 42, tank 46, and cylinder head 44, cooperate to form a triangle in side view, the center of the gravity is located in the neighborhood of the center of the triangle. Thus, the air compressor assembly is stable when standing.

Furthermore, since the plane plates 52 extend generally radially outwardly to the arc-shaped plate 50, the plates 52 and the tank 46 can be spaced apart. Therefore, there are provided relatively broad spaces around the nuts 60, in which it is easy to tighten the nuts 60. The pressure gage 70, pressure valve 72, safety valve 74, and so on, can be installed between the nuts 60 and the tank 46 after the nuts 60 are tightened, so that the compressor assembly 40 is more compact.

When hanging the handles 62 for transporting the compressor assembly 40, the tank 46 and the compressor body 42 are aligned vertically, so that it can be easily held under a stable condition.

While a first embodiment is described above, it is possible to provide various modifications, variations or alterations. Some examples follow.

The joining part 48 can be welded to the compressor body 42. And the plane plates 52 can be tightened to the tank 46 by the nuts 60.

While the compressor body 42 and the tank 46 are disposed at the same elevation when used in an embodiment described above, the present invention can be applied to a type which has a tank and compressor body mounted on the tank; or which has a compressor body and a tank mounted on the compressor body.

While anchor bolts are used in the above embodiment, the joining part 48 can be affixed to the projections 56 with bolts which have heads. In this case, the projections 56 have female threads and the plane plates 52 have apertures through which the bolts pass instead of the slits 54.

SECOND EMBODIMENT

Figure 8:
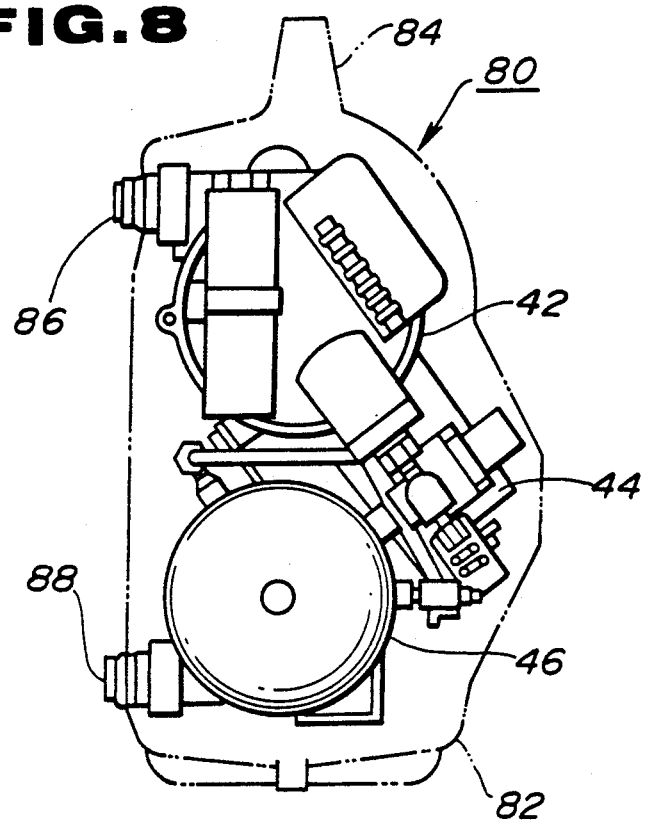
FIG. 8 is a side view showing a portable air compressor assembly according to a second embodiment of the present invention.

FIG. 8 depicts a portable compressor assembly 80 according to a second embodiment of the present invention. The compressor assembly 80 is of a generally similar structure to the above-described compressor assembly 40 shown in FIGS. 5 and 6. However, the compressor assembly 80 has no handles 62 which are affixed to the air tank 46 and has a casing 82 including a handle 84, which covers the compressor assembly 80 itself.

Furthermore, the compressor assembly 80 has four legs 86 and 88 extending from the casing 82, instead of the legs 64 of FIGS. 5 and 6. A pair of legs 86 are provided at the bottom of the compressor body 42 in such a manner that the legs 86 are disposed on an imaginary line parallel to the axis of the compressor body 42. Another pair of legs 88 are provided to the bottom of the air tank 46 in such a manner that the legs 88 are disposed on an imaginary line parallel to the axis of the compressor body 42. Therefore, the legs 86 and 88 are disposed in an imaginary plane which is opposite to the cylinder head 44 via the axis of the compressor body 42. When driving the compressor assembly 80, the legs 86 and 88 contact the ground or floor.

Figure 9:
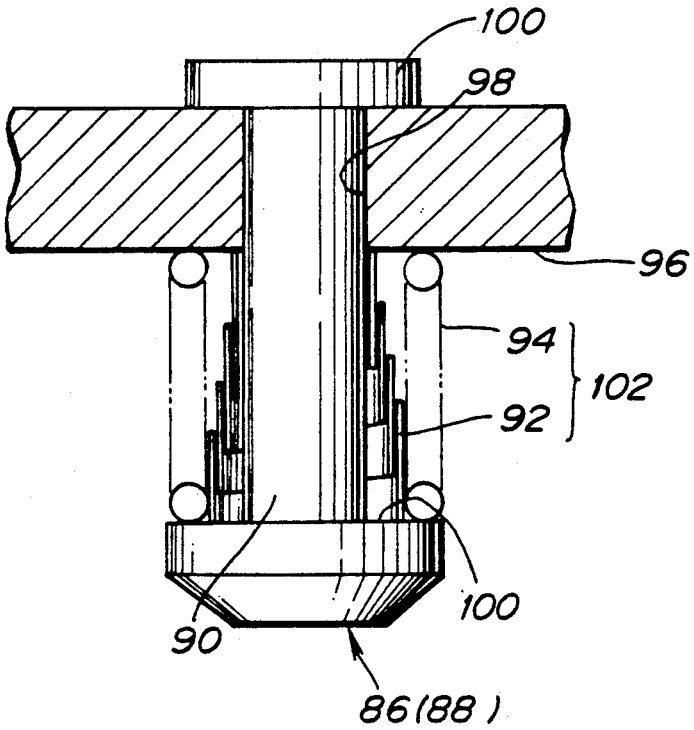
FIG. 9 is a side view showing an example of legs for suppressing vibration of the air compressor assembly of the second embodiment.

As shown in FIG. 9, each of the legs 86 and 88 consists of a rigid bar 90 of a circular cross section, a spiral strip 92 of a metal wound around the rigid bar 90, and a helical coil spring 94 wound around the spring 90. The spiral strip 92 is wound around an axis, in which the strip 92 continuously recedes from the axis and is continuously displaced along one direction of the axis at each turn of the spiral. In FIG. 9, number 96 indicates a rigid plate affixed to the bottom of the compressor body 42 or the air tank 46. When driving the compressor assembly 80, all the plates 96 are parallel to the floor or ground. The plate 96 has circular through-holes 98 to hold the legs 86 or 88. The rigid bar 90 is inserted into the hole 98 and has a pair of flanges 100 at both ends to prevent removal of the rigid bar 90 from the rigid plate 96 and to prevent removal of the spring 94 and spiral strip 92. The helical coil spring 94 mainly supplies the elastic force. The spiral strip 92 mainly supplies damping force because of the friction between the turns of the spiral. For convenience, each set of the coil spring 94 and spiral strip 92 is referred to a spring means 102.

While the compressor assembly 80 is stable for standing, the compressor assembly is not balanced because the air tank 46 is much lighter than the compressor body 42. The legs 86 receive much heavier weight than that of legs 84. Accordingly, spring means 102 of the legs 86 and legs 88 have different spring moduli according to the distributions of the weight of the compressor assembly 80. Generally, the spring means 102 of the legs 86 which receive heavier weight have a greater spring modulus. The spring moduli of the spring means 102 are defined such that the natural frequency f of the compressor assembly 80 is given by the following formula:

$$f<N/1.4$$

wherein N is a frequency of the compressor assembly 80 which may be caused by the driving speed of the compressor body 42.

If the formula is explained in other words, the compressor assembly 80 vibrates at the frequency f which are much lower value than the frequency N so as to be adequate to attenuate the vibration of the compressor assembly 80. Accordingly, the vibration of the compressor assembly 80 can be effectively suppressed. Especially, the legs 86 and 88 is extremely advantageous for a compressor assembly of which a ratio of the load received by a leg 86 over the load received by a leg 88 is less than 100/150, so that the loads are very different from each other.

OTHER EXAMPLES OF LEGS

Figure 10:
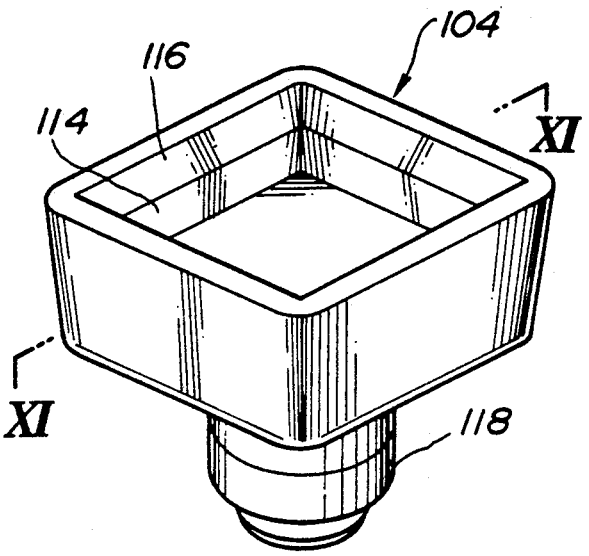
FIG. 10 is a perspective view showing another example of the legs.
Figure 12:
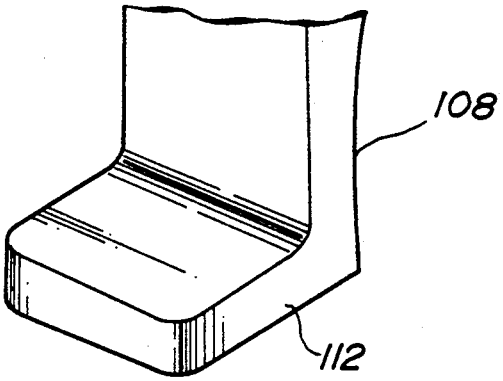
FIG. 12 is a perspective view showing an engaging part equipped to the compressor assembly for engaging with the leg in FIG. 10.
Figure 13:
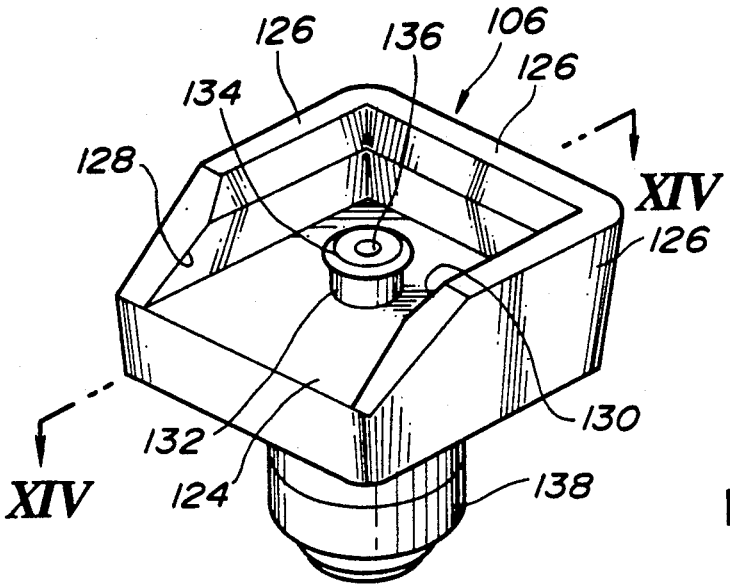
FIG. 13 is a perspective view showing another example of the legs which cooperate with the legs of FIG. 10 used for the common compressor assembly.

FIGS. 10 and 13 depict another example of a set of the legs 104 and 106 used for the same compressor assembly 80. The legs 104 and 106, which are made of a rubber, respectively have spring moduli according to the configurations and the hardness thereof. The damping forces of the legs 104 and 106 originate from friction of the particles in the rubber. The compressor assembly 80 has a pair of engaging parts 108 shown in FIG. 12 for engaging with a pair of the legs 104, attached to the bottom of the tank 46 in such a manner that the legs 104 are disposed on an imaginary line parallel to the axis of the tank 46. In addition, the compressor assembly 80 has another pair of engaging parts 110 shown in FIG. 15 for engaging with a pair of the legs 106, attached to the bottom of the compressor body 42 in such a manner that the legs 106 are disposed on an imaginary line parallel to the axis of the compressor body 42. Therefore, the legs 104 and 106 are disposed in an imaginary plane which is opposite to the cylinder head 44 via the axis of the compressor body 42. The plane plates 96 of the above embodiment are replaced.

Figure 11:
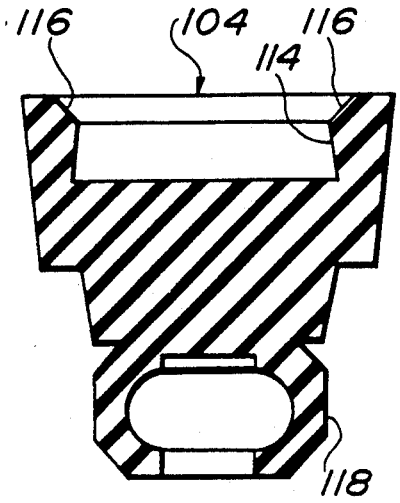
FIG. 11 is a side elevation along line XI—XI in FIG. 10.

The engaging part 108 shown in FIG. 12 which is of a L-shaped plate has a bottom plate 112 of a rectangular plate-shape. The legs 104 shown in FIGS. 10 and 11 are provided to the compressor body 42 instead of the legs 86. Shore hardness $H_s$ of the legs 104 is about 70. The leg 104 of a rectangular box-shaped has a hollow 114 of a circular cross section opening upward for engaging with the bottom plate 112 of the engaging part 108, bevelling 116 at the upper inner corners of the hollow 114, and leg section 118 extending downward from the bottom of the box-shape. The hollow 114 tapers from the bottom to the opening thereof so that the leg 104 is not removed easily from the bottom plate 112 of the engaging part 108.

Figure 14:
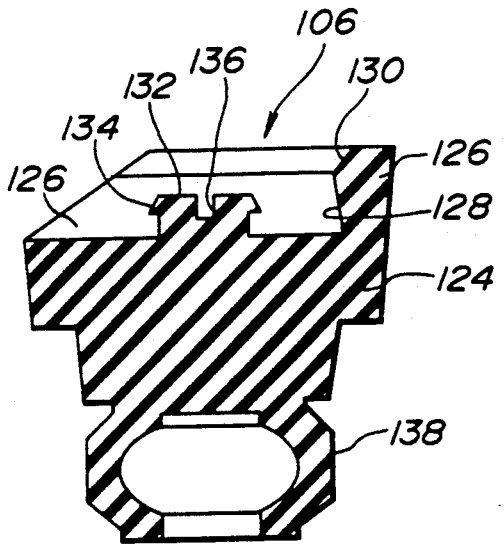
FIG. 14 is a side elevation along line XIV—XIV in FIG. 10.
Figure 15:
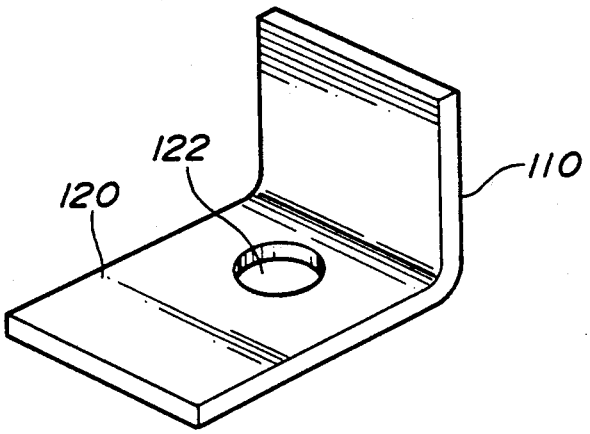
FIG. 15 is a perspective view showing another engaging part equipped to the compressor assembly for engaging with the leg in FIG. 13.

The engaging part 110 shown in FIG. 15 which is of an L-shaped plate has a bottom plate 120 of a rectangular plate-shape and a circular through-hole 122 at the bottom plate thereof. The legs 106 shown in FIGS. 13 and 14 are provided to the tank 46 instead of the legs 88. Shore hardness $H_s$ of the legs 106 is about 60. The leg 106 of a generally rectangular box-shaped has a rectangular bottom 124 and three side plates 126 extending upward perpendicularly from the bottom 124, for determining a recess 128 of a circular cross section opening upward for engaging with the bottom plate 120 of the engaging part 110. The recess 128 is determined by three side plates 126, so that the recess 128 opens at one side. Bevelling 130 is formed at the upper inner corners of the recess 128. The plates 126 taper downwardly, so that the recess 128 tapers from the bottom to the upper opening thereof. At the center of the recess 128, a projection 132 of a circular cross section projects from the bottom 124 upwardly for engaging with the through-hole 122 of the engaging part 110. The projection 132 has a flange 134 expanding radially at the top thereof, of which the diameter is larger than that of the through-hole 122. And the projection 132 has a hole 136 concentric thereto at the top face thereof for transforming easily when the projection 132 is inserted into the through-hole 122. Therefore, the leg 106 is not removed easily from the bottom plate 120 of the engaging part 110. The leg 106 further has a leg section 138 extending downward from the bottom of the box-shape.

Accordingly, the legs 104 are engaged easily with the engaging parts 108 because of the bevelling 116, while the legs 104 cannot be removed easily because of the tapering hollow 114. Also the legs 106 are engaged easily with the engaging parts 110 because of the bevelling 130 and the hole 136, while the legs 106 cannot be removed easily because of the tapering recess 128 and the flange 134.

Since the legs 104 receive much greater weight than that of the legs 102, the legs 104 and 106 have different spring moduli according to the distribution of the weight of the compressor assembly 80. Generally, the legs 104 which receive greater weight have more greater spring modulus. The spring moduli of the legs 104 and 106 are defined such that the natural frequency f of the compressor assembly 80 is given by the following formula:

$$f<N/1.4$$

wherein N is a frequency of the compressor assembly 80 which may be caused by the driving speed of the compressor body 42.

If the formulae are explained in other words, the compressor assembly vibrates at the frequencies f which are of a much lower value than the frequency N so as to be adequate to attenuate the vibration of the compressor assembly 80. Accordingly, the vibration of the compressor assembly 80 can be effectively suppressed. Especially, the legs 104 and 106 are extremely advantageous for a compressor assembly of which a ratio of the load received by a leg 104 over the load received by a leg 106 is less than 100/150, so that the loads are very different from each other.

Furthermore, the compressor assembly 80 has two pairs of the legs 104 and 106, the shapes of each the pairs being different from each other. The shapes of engaging parts 108 and 110 are different from each other, for engaging respectively with the legs 104 and 106. Therefore, misattaching of the legs and engaging parts is prevented, so that the above suppressing effect can be achieved with certainly.

What is claimed is:

1. An air compressor assembly comprising:

an air tank being of a generally circular cross section, having a center axis therealong and a peripheral portion;

a compressor body for supplying compressed air to the air tank, the compressor body being of a generally circular cross section, having a center axis therealong and having a peripheral portion, the axis of the compressor body being disposed parallel to the axis of the tank, the compressor body including a cylinder head, the cylinder head having an axis therealong, the axis of the cylinder head being disposed perpendicular to the axis of the compressor body and inclined toward the tank;

a joining part for joining the air tank and compressor body, the joining part having a fixed portion and at least one attached portion, the fixed portion being fixed to the peripheral portion of one of the air tank and the compressor body, the attached portion being detachably attached to the peripheral portion of the other of the air tank and the compressor body, the attached portion extending along a tangential direction of the other of the air tank and the compressor body; wherein a pressure gage, a pressure valve, and a safety valve are disposed in a space defined by a peripheral portion of the cylinder head and by the peripheral portions of the air tank and the compressor body, and wherein said cylinder head, the pressure gage, the pressure valve and the safety valve are arranged in a direction along the axes of the tank and the compressor body, said compressor body and said tank having a plurality of legs, the legs being attached to the compressor body and the air tank in an imaginary plane which is opposite to said cylinder head via the axis of the compressor body, each of the legs having a spring modulus according to the distribution of the weight of the compressor assembly such that a natural frequency f of the compressor assembly is given by the following formula:

$$f<N/1.4$$

wherein N is a frequency of the compressor assembly while the compressor body is driven.

2. An air compressor assembly according to claim 1, wherein said compressor body and said air tank respectively include engaging parts for engaging respectively with said legs, said engaging parts having various configurations respectively, said legs having various configurations respectively to be engaged with the engaging parts respectively.

3. An air compressor assembly comprising:

an air tank having an axis therealong;

a compressor body adjacent to the tank for supplying compressed air to the air tank, said compressor body having an axis therealong, the axis of the compressor body being disposed parallel to the axis of the tank, the compressor body including a cylinder head, the cylinder head having an axis therealong, the axis of the cylinder head being disposed perpendicular to the axis of the compressor body and inclined toward the tank; and a joining part for joining the air tank and the compressor body;

wherein said compressor body and said air tank have a plurality of legs, the legs being attached to the compressor body and the air tank in an imaginary plane which is opposite to said cylinder head relative to the axis of the compressor body, each of the legs having a spring modulus according to the distribution of the weight of the compressor assembly such that a natural frequency f of the compressor assembly is given by the following formula:

$$f<N/1.4$$

wherein N is a frequency of the compressor assembly while the compressor assembly is driven.

4. An air compressor assembly according to claim 3, wherein said compressor body and said air tank include engaging parts for engaging with said legs, said engaging parts having various configurations, said legs having various configurations to be engaged with the engaging parts.

5. An air compressor assembly comprising:

an air tank having an axis therealong;

a compressor body adjacent the tank for supplying compressed air to the air tank, said compressor body having an axis therealong, the axis of the compressor body being disposed parallel to the axis of the tank, the compressor body including a cylinder head, the cylinder head having an axis therealong, the axis of the cylinder head being disposed perpendicular to the axis of the compressor body and inclined toward the tank; and a joining part for joining the air tank and compressor body, the joining part having a fixed portion and an attached portion, the fixed portion being fixed to one of the air tank and compressor body, the attached portion being detachably attached to the other of the air tank and compressor body;

wherein said compressor body and said air tank have a plurality of legs, the legs being attached to the compressor body and the air tank in an imaginary plane which is opposite to said cylinder head relative to the axis of the compressor body, each of the legs having a spring modulus according to the distribution of the weight of the compressor assembly such that a natural frequency f of the compressor assembly is given by the following formula:

$$f<N/1.4$$

wherein N is a frequency of the compressor assembly while the compressor assembly is driven.

6. An air compressor assembly according to claim 5, wherein said compressor body and said air tank include engaging parts for engaging with said legs, said engaging parts having various configurations, said legs having various configurations to be engaged with the engaging parts.

* * * * *